United States Patent [19]

Schrudde

[11] 4,073,251

[45] Feb. 14, 1978

[54] LUBRICATING DEVICE FOR A ROTARY LOOPTAKER

[75] Inventor: Reinhold Schrudde, Bielefeld, Germany

[73] Assignee: Kochs Adler AG, Bielefeld, Germany

[21] Appl. No.: 780,758

[22] Filed: Mar. 24, 1977

[51] Int. Cl.[2] ..... D05B 71/00

[52] U.S. Cl. ..... 112/256

[58] Field of Search ..... 112/256, 231, 228; 184/6.15

[56] References Cited

U.S. PATENT DOCUMENTS

| | | | |
|---|---|---|---|
| 3,146,745 | 9/1964 | Schenkengel | 112/256 |
| 3,513,794 | 5/1970 | Bernewasser | 112/256 |
| 3,773,020 | 11/1973 | Schrudde | 112/256 |
| 3,955,520 | 5/1976 | Gebhardt | 112/256 |

*Primary Examiner*—George H. Krizmanich
*Attorney, Agent, or Firm*—Max Fogiel

[57] ABSTRACT

A lubricating arrangement for the raceway of the bobbin case of a rotary sewing machine looptaker having a body with a recess formed by a bottom and a substantially cylindrical sidewall for holding the bobbin case. A hub of the looptaker has an oil collecting chamber in the form of an annular cavity with undercut inside peripheral area. The chamber receives oil supplied from an oil collecting sump. Centrifugal action causes the oil to flow through a conduit located between the oil collecting chamber and the bottom of the recess, via an adjusting device, to the raceway for the bobbin case. For regulating the oil delivery, the conduit is surrounded along a portion of its length by a borehole located in the bottom. An adjusting screw is provided for tilting the conduit in relation to the axis of the loop taker. An oil collecting sump closed by a cover, is in the bottom of the looptaker body. Oil is supplied to the oil collecting sump through a hollow looptaker shaft. The oil collecting sump has a sidewall tapering towards the bottom of the recess, and an oil line extends from the oil collecting sump outward to the oil collecting chamber for delivering oil from the sump to the collecting chamber.

8 Claims, 3 Drawing Figures

LUBRICATING DEVICE FOR A ROTARY LOOPTAKER

BACKGROUND OF THE INVENTION

The present invention relates to a lubricating device for the raceway of the bobbin case of a rotary sewing machine looptaker whose body has a recess, formed by a bottom and an essentially cylindrical sidewall, for holding the bobbin case. The hub of the looptaker has an oil collecting chamber comprising an annular cavity with undercut inside peripheral area. This chamber receives the oil supplied from an oil collecting sump. Centrifugal action causes the oil to flow through a conduit, located between the oil collecting chamber and the bottom of the recess, via a adjusting device to the raceway for the bobbin case.

It is the purpose of the present invention to provide the raceway of the bobbin case of a rotating looptaker with an adequate but not excessive amount of lubricant, both immediately after starting the sewing machine and at a high rpm, with the required amount of lubricant adjustable by simple adjusting means.

There are already known in the art lubricating devices for rotating looptakers equipped with an adjusting device for metering the lubricant delivered to the raceway of the bobbin case.

Thus, from the German Utility Pat. No. 1,716,619 there is known a device for looptaker lubrication where the amount of lubricant delivered by capillary action to the looptaker is set by a setscrew varying the cross-section of the wick located in a plastic hose. This setscrew is in the vicinity of the oil reservoir.

There are also known looptaker lubricating devices for looptakers rotating about a vertical axis, e.g., from the German Patent Document 831,187 where the oil in a reservoir is pumped by means of a pump into the hollow looptaker shaft and delivered to a wick located in the borehole of the looptaker shaft and terminating in the looptaker "basket". The amount of oil can be adjusted by a valve screw with a conically pointed end. This screw is located in the line connecting the pump to the bottom end of the hollow shaft.

With these known lubricating devices, the setting of an accurately metered oil quantity is very time consuming since the looptaker, because of the oil supply in the wick, must run for quite a while till a changed setting has an effect.

From the U.S. Pat. 2,659,331, there is known a looptaker lubricating device where a lubricant reservoir in the form of a cylindrical ring is fastened coaxially on the looptaker and connected to the raceway of the looptaker by means of a lubricant line on the periphery of the ring. Adjustment is made by a screw which can be turned into the inside of the lubricant line; by varying the cross-section. This screw causes a change of the rate of the flow of the lubricant.

Another adjusting device based on the principle of cross-sectional variation has been proposed in the German Patent Application No. P 6123 Cl. 52*a*, 57/05 for lubricating a looptaker which is connected directly or indirectly with a rotating oil catching receptacle in the form of a truncated hollow cone. Through a supply pipe which runs parallel to the looptaker shaft and is equipped with an adjusting device in the form of a faucet, the oil flows into the catching receptacle and is moved by the centrifugal force, arising during rotation of the looptaker, through one or several channels to the bobbin case raceway.

According to the German Pat. 1,158,799, a looptaker lubricating device which permits sensitive and immediate regulation of the oil flow in the immediate vicinity of the looptaker raceway and which prevents a flooding of the looptaker raceway when the machine stops can be provided as follows: The end of a supply pipe, running parallel to the looptaker shaft and connecting the oil collecting chamber, open at the rear and fastened to the looptaker hub, to the bottom of the looptaker, projects into the bottom of the looptaker only so far that the head of an adjustment screw fastened into the supply pipe is completely within the opening in the bottom of the looptaker.

With these lubricating devices, known from the last-mentioned patents, for the raceway of the bobbin case, the adjusting means for the lubricant supply are in the immediate vicinity of the point of lubrication so that a sensitive and immediate metering of the oil supply is achieved.

With lines, located inside the looptakers to supply oil, of relatively small cross-section, there is danger of adding fillers separated by the needle during sewing and by the cloth feeder from the cloth (dressing glue, etc.), so that these channels frequently have to be unclogged by means of a wick. This hazard increases if these channel cross-sections or lines are narrowed considerably by the proposed adjusting means. Accordingly, the channels must be cleaned very frequently after the adjusting screw has been removed or the faucet is opened; as a result, the previously determined accurate setting to the desired flow rate becomes lost.

It is an object of the present invention to provide a lubricating device suitable for looptakers rotating about a vertical or a horizontal axis which makes it possible to deliver an accurately metered and constant oil quantity to the raceway for the bobbin case, without the use of wicks and adjusting means narrowing the oil supply channels.

Another object of the present invention is to provide a lubricating device of the foregoing character which is substantially simple in construction and may be economically fabricated.

A further object of the present invention is to provide a lubricating arrangement, as described, which may be readily maintained in service, and which has a substantially long operating life.

SUMMARY OF THE INVENTION

The objects of the present invention are achieved by providing that to meter the oil delivery, the conduit is surrounded along a portion of its length by a borehole in the bottom of the looptaker and an adjusting screw is provided for tilting the conduit relative to the axis of the looptaker.

With a looptaker having an oil collecting sump which is in the bottom of the recess for holding the bobbin case and closed by a cover, to which oil collecting sump the oil is supplied through the hollow looptaker shaft, the oil collecting sump has a sidewall tapering off conically toward the bottom of the cavity; an oil line extends outward from the oil collecting sump to the oil collecting chamber to deliver the oil from the oil collecting sump to the inside peripheral area of the oil collecting chamber or, to return the excess oil to the oil reservoir.

To pass the oil from the bottom of the recess to the raceway of the looptaker, an oil groove located in the vicinity of the borehole for the conduit and extending at an angle with the looptaker path outward to the raceway is provided in the sidewall of the recess.

With a looptaker rotating about a vertical axis, the oil groove terminates in an oil pocket which is located in the bottom of the recess and which collects the oil running back when the looptaker stands still.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figures 1, 2, 3:
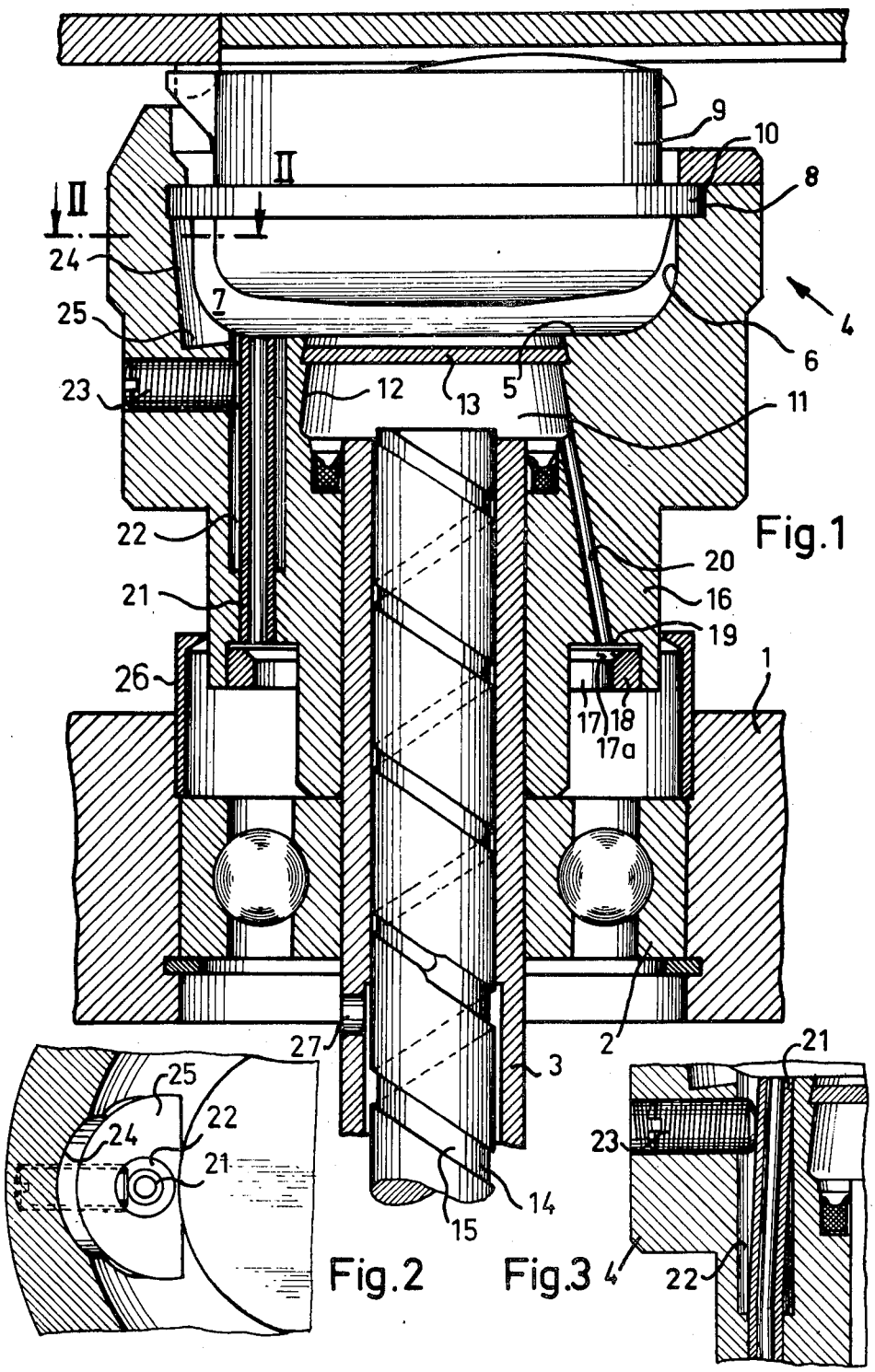
FIG. 1 shows a sectional view of a looptaker, rotating about a vertical axis, with the lubricating device for the raceway of the bobbin case, in accordance with the present invention, on an enlarged scale.
FIG. 2 shows a sectional view taken along line II–II of FIG. 1.
FIG. 3 shows a sectional view of FIG. 1 with the adjusting device set to deliver a small quantity of lubricant.

A hollow looptaker shaft 3, carrying a looptaker 4, is held inside ball bearings 2 in a housing of 7 sewing machine 1 (not shown). This looptaker is provided with a recess 7, formed by a bottom 5 and a cylindrical side wall 6, and an annular raceway 8 in which the bearing rib 10 of a bobbin case 9 is supported. The bottom 5 of recess 7 has an oil collecting sump 11 which has a sidewall 12 which tapers off towards the bottom 5. This oil collecting sump 11 is closed by a cover 13.

The hollow looptaker shaft 3, terminating in the oil collecting sump 11, is pivoted about a spindle 14 which has a helical groove 15 and is fixed in a known manner (not shown) in the lower portion of the housing 1 and is connected to the oil reservoir (U.S. Pat. No. 3,773,020).

The hub 16 of the looptaker 4 contains an annular cavity 17 in which a ring 18 is inserted; this ring has an undercut 19 at its inner lateral edge turned (inclined downward) to the bottom surface of the annular cavity 17 and forms an oil collecting chamber **17*a*. The looptaker 4 is provided with an oil line 20 which extends from the oil collecting sump 11 outward to the oil collecting chamber 17*a***.

The looptaker 4 holds a conduit 21 which is received in a bore in the hub 16 and surrounded with space along a major portion of its length by a counterbore 22 which is below the bottom 5 or recess 7. Thus, counterbore 22 is above the lower portion of the bore receiving snugly the lowe end of conduit 21. The opening of the conduit 27, terminating in oil collecting chamber **17*a*, is in the region of the undercut peripheral area 19 of ring 18. The conduit 21, which has a slight inclination outward, can be deflected by means of an adjusting screw 23 relative to the axis of the looptaker 4**.

As evident from FIGS. 1 and 2, in the area of counterbore 22 for the conduit 21, there is provided, an oil groove 24 is inclined upwardly and outwardly to raceway 8 in the sidewall 6 of recess 7. This oil groove 24 terminates in an oil pocket 25 which is slightly tilted to the bottom 5 in the area of counterbore 22 and surmounted by conduit 21.

In order to prevent the centrifugal ejection of oil, there is an oil collecting ring 26 which is seated in the housing and encloses, hub 16 of the looptaker 4 with small play.

In operation of the lubricating device according to the present invention, the oil is delivered by the rotation of the looptaker shaft 3, in conjunction with spindle 14, from an oil supply through the helical groove 15 into oil collecting sump 11 after an excess oil quantity was allowed to flow back, through a side borehole 27 in the looptaker shaft 3, to the oil supply. Due to the centrifugal action, caused by the rotation of looptaker 4, oil is forced through the oil line 20 into the oil chamber **17*a* which is in the hub 16; an excess amount of the delivered oil flows to the ball bearing 2 and only predetermined amount of oil can be received by oil collecting chamber 17*a*, when the looptaker 4 rotates. Consequently, as the undercut 19 of the inserted ring 18 has a flared out enlargement in direction to the bottom surface of the annular cavity of the hub 16, the oil being in the oil collecting chamber 17*a* will flow outwards and upwards, and accordingly it flows through the conduit 21 into the recess 7 and from there likewise by the centrifugal action into the oil pocket 25 and via the oil groove 24 to the raceway 8**.

A very precise metering of the oil quantity required for lubricating raceway 8 can be achieved by deflecting the conduit 21, which is made of flexible material, in relation to the axis of the looptaker 4 by means of adjusting screw 23. The oil quantity reaching the recess is lowest if the conduit 21 is deflected at most towards the axis of the looptaker 4, as shown in FIG. 3, because, in this case, the centrifugal action causes that the oil flown into the conduit 21, will be pressed downwards to the oil collecting chamber **17*a*, and vice versa. The deflection of the conduit 21** in relation to the looptaker axis allows inherently for variation in the radial distance and therefore in variation of the centrifugal effect which is dependent on the radial distance.

After the machine has stopped, part of the oil located on sidewall 6 collects in oil pocket 25 (FIGS. 1 and 2). This quantity is sufficient to immediately lubricate the raceway 8 even after the machine was inoperative for some time.

Cleaning of the possibly clogged conduit 21 can be done quickly. It is only necessary to remove the bobbin from the bobbin case 9 in order to clear the conduit 21 by means of a pipecleaner or wire passed through the opening in the bobbin case bottom.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptions should and are intended to be comprehended within the meaning and range of equivalence of the following claims.

What is claimed is:

1. A lubricating device for the raceway of the bobbin case of a rotary sewing machine looptaker, comprising: a driven hollow shaft carrying said looptaker; a body with a recess formed by a bottom and a substantially cylindrical sidewall for holding the bobbin case; a hub on said body; an oil collecting chamber in said hub and having an annular cavity with an undercut inside peripheral area; an oil line in said body for leading oil supplied from an oil reservoir via said hollow shaft to said oil collecting chamber; a conduit for leading oil from said oil collecting chamber to said recess and said raceway for said bobbin case by centrifugal action, said conduit being received in a bore in said body and surrounded by a space along a portion of its length by a counterbore; regulating means for regulating the oil delivery to said raceway and comprising adjusting screw means for tilting said conduit in relation to the axis of the looptaker.

2. The lubricating device as defined in claim 1 including an oil collecting sump in the bottom of said recess of said looptaker body, said oil collecting sump having a sidewall tapering towards said bottom of said recess, said oil line extending from said oil collecting sump outward to said oil collecting chamber; means for covering said oil collecting sump; means for supplying oil from said oil reservoir to said oil collecting sump and comprising; a stationary spindle within said hollow looptaker shaft and having a helical groove ending in said oil reservoir and said oil collecting sump.

3. The lubricating device as defined in claim 1 including an oil groove in said sidewall of said recess, for gathering the oil delivered into said recess of centrifugal action, said oil groove being located in vicinity of said counterbore and extending outward to said raceway with respect to said looptaker axis, for transferring oil gathered in said oil groove to said raceway by centrifugal action.

4. The lubricating device as defined in claim 3 including an oil pocket in the bottom of said recess for collecting oil running down when said looptaker is at rest, said oil groove terminating in said oil pocket.

5. The lubricating device as defined in claim 2 including an oil groove for gathering oil delivered into said recess by centrifugal action and located in said sidewall of said recess, said oil groove being located in vicinity of said counterbore and extending outward to said raceway with respect to said looptaker axis, for transferring oil gathered in said oil groove to said raceway by centrifugal action.

6. The lubricating device as defined in claim 1 including an oil collecting sump in said bottom of said recess of said looptaker body; means for covering said oil collecting sump; means for supplying oil to said oil collecting sump, said oil collecting sump having a sidewall tapering towards said bottom of said recess, said oil line extending from said oil collecting sump outward to said oil collecting chamber for delivering oil from said oil collecting sump to said oil collecting chamber, an oil groove in said sidewall of said recess for gathering oil delivered into said recess by centrifugal action, said oil groove being located in vicinity of said counterbore and extending outward to said raceway with respect to said looptaker axis, for transferring oil gathered in said oil groove to said raceway by centrifugal action, and an oil pocket in the bottom of said recess for collecting oil running down when said looptaker is at rest, said oil groove terminating in said oil pocket.

7. The lubricating device as defined in claim 1, including a ring inserted in an annular cavity located in said hub for forming said oil collecting chamber; said ring having an undercut at its inner lateral edge turned to the bottom surface of said annular cavity, for gathering oil in said oil collecting chamber and supplying the gathered oil into said conduit by centrifugal action when said looptaker rotates.

8. The lubricating device as claimed in claim 6 including a housing with a lower portion connected with said oil reservoir, and means for supplying oil from said oil reservoir to said oil collecting sump comprising: a spindle stationarily located in said lower portion of said housing and received in said hollow looptaker shaft, said spindle having a helical groove ending in said oil reservoir and said collecting sump.

* * * * *